US005749648A

United States Patent [19]

Lin

[11] Patent Number: 5,749,648

[45] Date of Patent: May 12, 1998

[54] LAMP FOR DECORATIVE LIGHT STRINGS

[76] Inventor: Wen-Chien Lin, P.O. Box 82-144, Taipei, Taiwan

[21] Appl. No.: 873,799

[22] Filed: Jun. 12, 1997

[51] Int. Cl.[6] ..... F21V 11/00

[52] U.S. Cl. ..... 362/353; 362/249; 362/806; 362/808

[58] Field of Search ..... 362/238, 226, 362/246, 248, 249, 353, 806, 808

[56] References Cited

U.S. PATENT DOCUMENTS 5,649,763 7/1997 Liou ..... 362/363
5,685,638 11/1997 Huang ..... 362/806 X

*Primary Examiner*—Stephen F. Husar
*Attorney, Agent, or Firm*—A & J

[57] ABSTRACT

A lamp for decorative light strings includes a lamp holder, a lamp base mounted in the lamp holder and holding a lamp bulb, a lampshade fastened to the lamp holder around the lamp base and the lamp bulb by a screw joint, and two electric wires respectively extended out of the lamp holder and having a respective contact terminal disposed in contact with the positive and negative terminals of the lamp bulb respectively, wherein the lamp holder comprises a cup-like holder base, a plurality of air vents at a bottom side of the cup-like holder base, a center barrel vertically disposed at the center of the cup-like holder base and defining a top receptacle, which receives the lamp base, and a hinged cap closed on one end of the center barrel remote from the top receptacle and having two semicircular notches for the passing of the electric wires.

3 Claims, 7 Drawing Sheets

LAMP FOR DECORATIVE LIGHT STRINGS

BACKGROUND OF THE INVENTION

Description of the Prior Art

FIG. 1 shows a lamp for decorative light strings according to the prior art. This structure of lamp is comprised of a lamp holder 4, a lamp base and shade unit 2 mounted in the lamp holder 4 to hold a lamp bulb 1, and two electric wires 3 adapted for connecting the positive and negative terminals of the lamp bulb 1 to power supply. This structure of lamp has drawbacks. In order for easy installation of the lamp bulb 1, the lamp base and shade unit 2 must have a broad top opening and its height must be limited. Further, the lamp base and shade unit 2 is fastened to the lamp holder 4 by plugging the bottom lamp base of the lamp base and shade unit 2 into the top opening of the lamp holder 4. If the size of the bottom lamp base of the lamp base and shade unit 2 does not perfectly fit the top opening of the lamp holder 4, the lamp base and shade unit 2 may be forced out of the lamp holder 4 easily. However, if the size of the bottom lamp base of the lamp base and shade unit 2 fits the top opening of the lamp holder 4 perfectly, it will be difficult to plug the bottom lamp base of the lamp base and shade unit 2 into the top opening of the lamp holder 4.

SUMMARY OF THE INVENTION

This invention has been accomplished to provide a lamp for decorative light strings which eliminates the aforesaid drawbacks. According to one aspect of the present invention, the lamp comprises a lamp holder, a lamp base mounted in the lamp holder and holding a lamp bulb, a lampshade fastened to the lamp holder around the lamp base and the lamp bulb, and two electric wires respectively extended out of the lamp holder and having a respective contact terminal disposed in contact with the positive and negative terminals of the lamp bulb respectively, wherein the lamp holder comprises a cup-like holder base, a plurality of air vents at a bottom side of the cup-like holder base, a center barrel vertically disposed at the center of the cup-like holder base and defining a top receptacle, which receives the lamp base, and a hinged cap closed on one end of the center barrel remote from the top receptacle and having two semicircular notches for the passing of the electric wires. This design allows the lamp bulb to be conveniently dismounted from the lamp holder and the lamp base for a replacement. According to another aspect of the present invention, the cup-like holder base of the lamp holder has an inner thread, and the lampshade has an outer thread around its bottom end adapted for threading into the inner thread of the cup-like holder base of the lamp holder.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
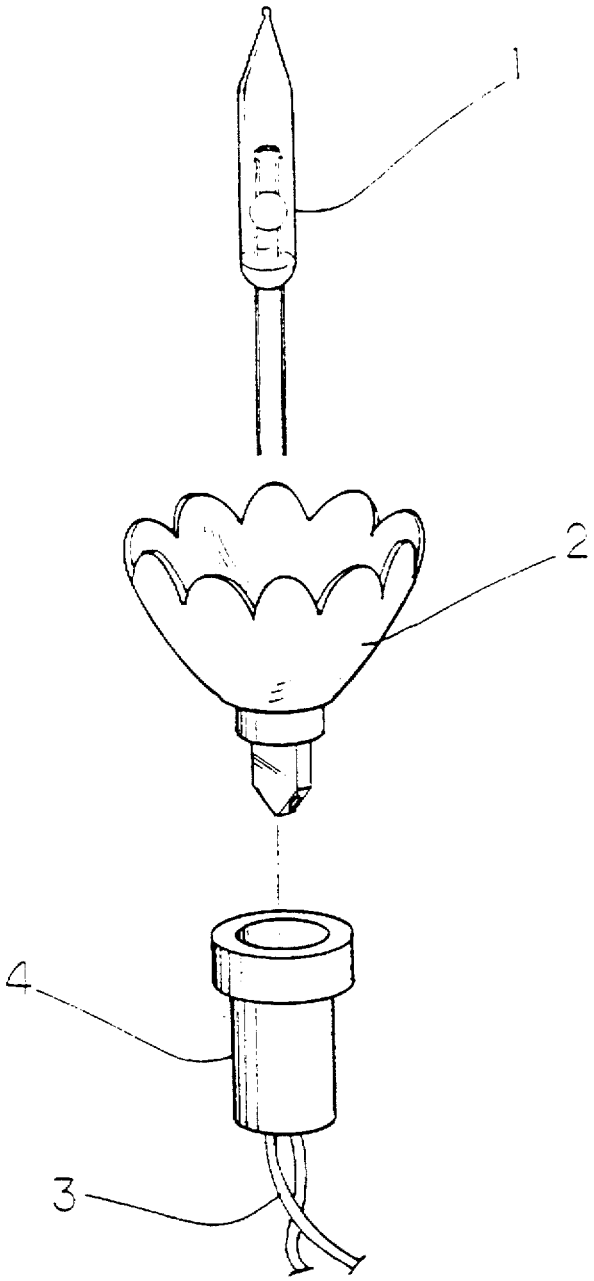
PRIOR ART FIG. 1
FIG. 1 is an exploded view of a lamp for decorative light strings according to the prior art.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
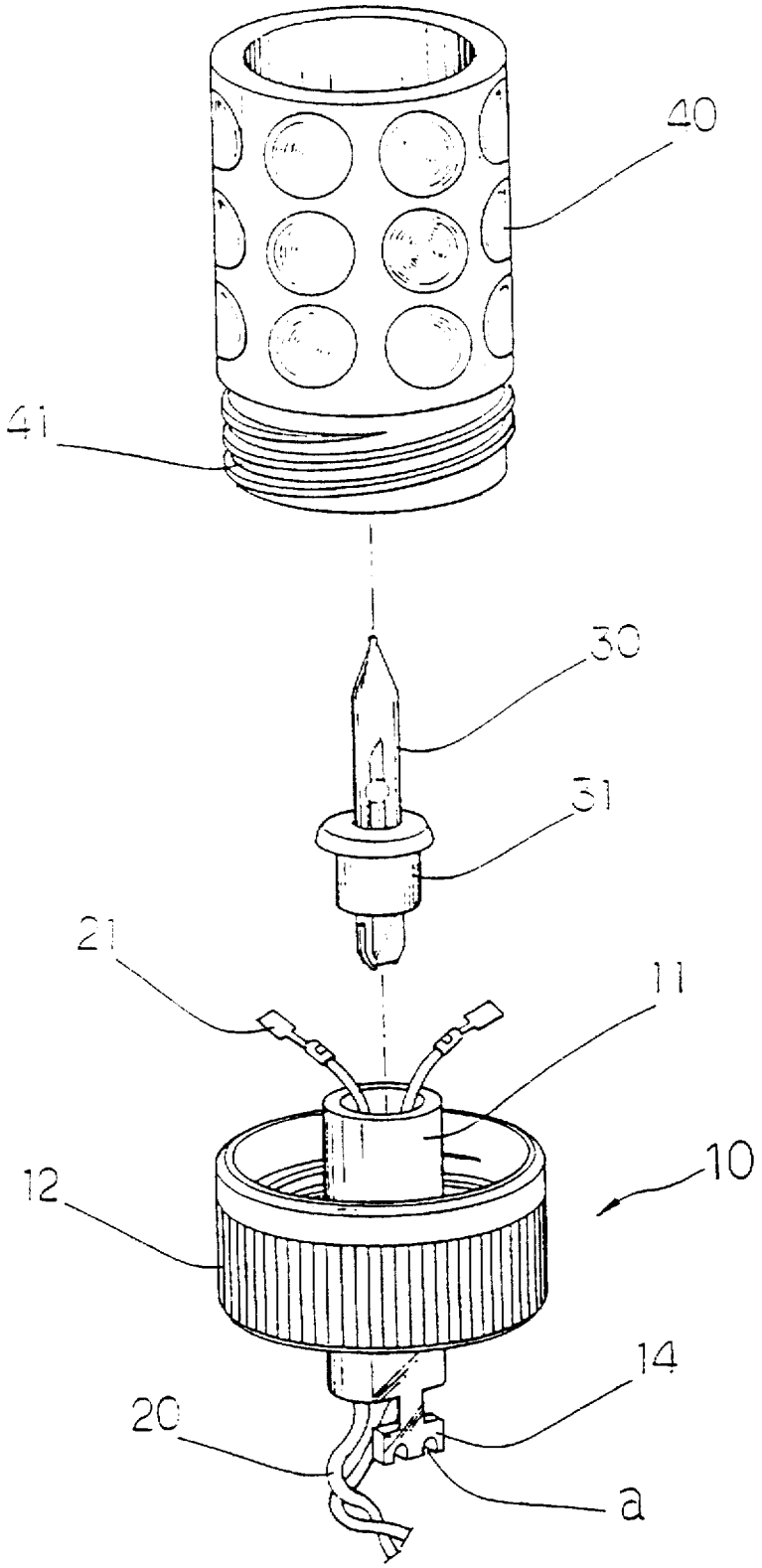
FIG. 2 is an exploded view of a lamp for decorative light strings according to the present invention.
Figure 3:
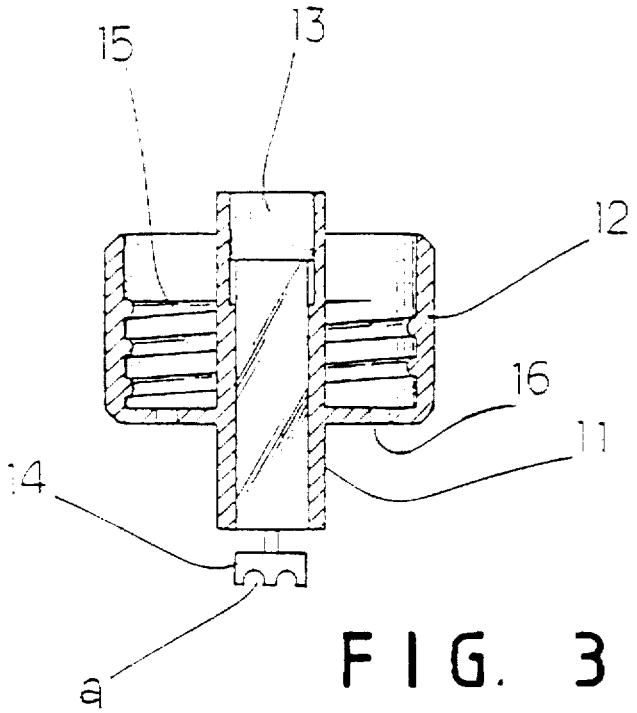
FIG. 3 is a sectional front view of the lamp holder shown in FIG. 2.
Figure 4:
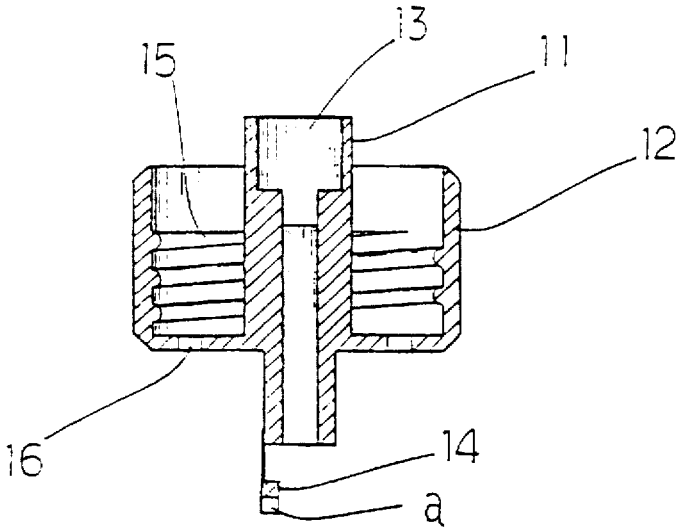
FIG. 4 is a sectional side view of the lamp holder shown in FIG. 3.

Referring to FIGS. 2, 3 and 4, a lamp for decorative light strings in accordance with the present invention is generally comprised of a lamp holder 10, two electric wires 20, a blamp bulb 30, a lamp base 31 holding the lamp bulb 30, and a transparent lampshade 40. The lampshade 40 has an outer thread 41 around the bottom end for connection to the lamp holder 10 by a screw joint. The lamp holder 10 comprises a cup-like holder base 12, an inner thread 15 disposed around the inside wall of the cup-like holder base 12 for engagement with the outer thread 41 of the lampshade 40, a plurality of air vents 16 at the bottom side of the cup-like holder base 12, a center barrel 11 vertically disposed at the center of the cup-like holder base 12 and defining a top receptacle 13 for receiving the lamp base 31, and a cap 14 hinged to the center barrel 11 outside the cup-like holder base 12 and adapted for closing the bottom end of the center barrel 11. The cap 14 has two semicircular notches a.

Figure 6:
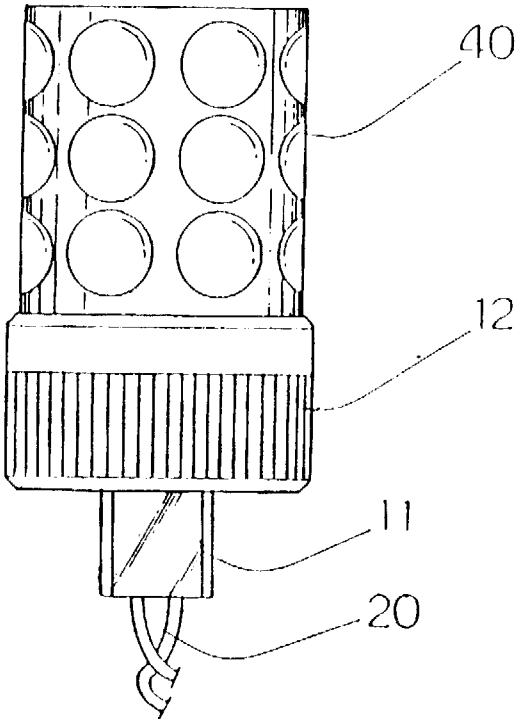
FIG. 6 is an elevational view of FIG. 5.
Figure 5:
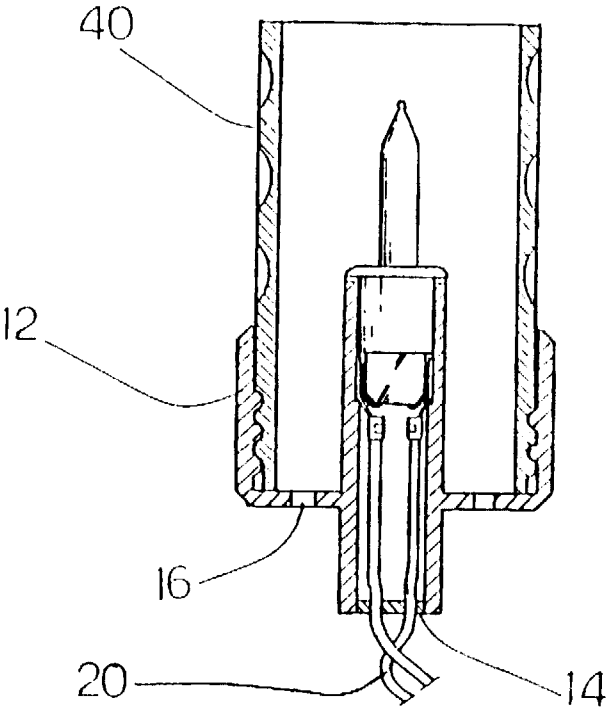
FIG. 5 is a sectional assembly view of the present invention.
Figure 7:
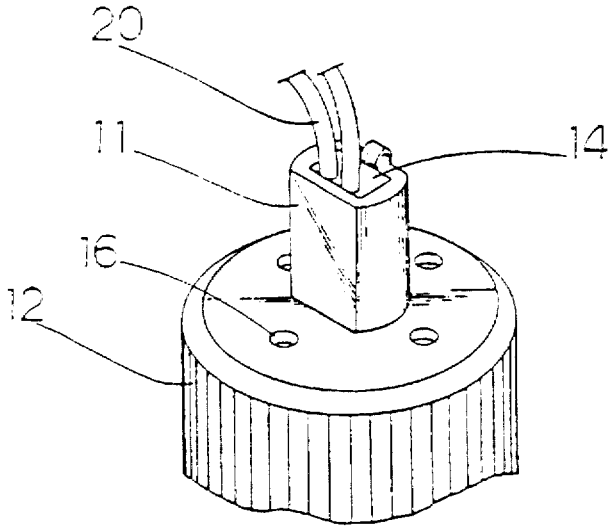
FIG. 7 shows the bottom side arrangement of the lamp shown in FIG. 6.

Referring to FIGS. 5, 6 and 7, when the lamp bulb 30 is mounted in the lamp base 31 and the electric wires 20 are inserted into the center barrel 11 of the lamp holder 10 from the bottom side, the lamp base 31 is plugged into the receptacle 13 of the center barrel 11, permitting the contact terminals 21 of the electric wires 20 to be firmly retained in contact with the positive and negative terminals of the lamp bulb 30, and then the lampshade 40 is fastened to the lamp holder 10 by threading the outer thread 41 of the lampshade 40 into the inner thread 15 of the cup-like holder base 12, and then the cap 14 is closed on the bottom side of the center barrel 11, permitting the electric wires 2 to be tightly retained in the semicircular notches a. Further, the lamp base 31 is slotted such that the contact terminals 21 of the electric wires 2 can be forced through slots in the lamp base 31 into contact with the positive and negative terminals of the lamp bulb 30. When installed, the bottom side of the center barrel 11 of the lamp holder 10 is sealed by the cap 14, therefore water is prohibited from passing to the inside of the center barrel 11 to wet the electric circuit.

Figure 9:
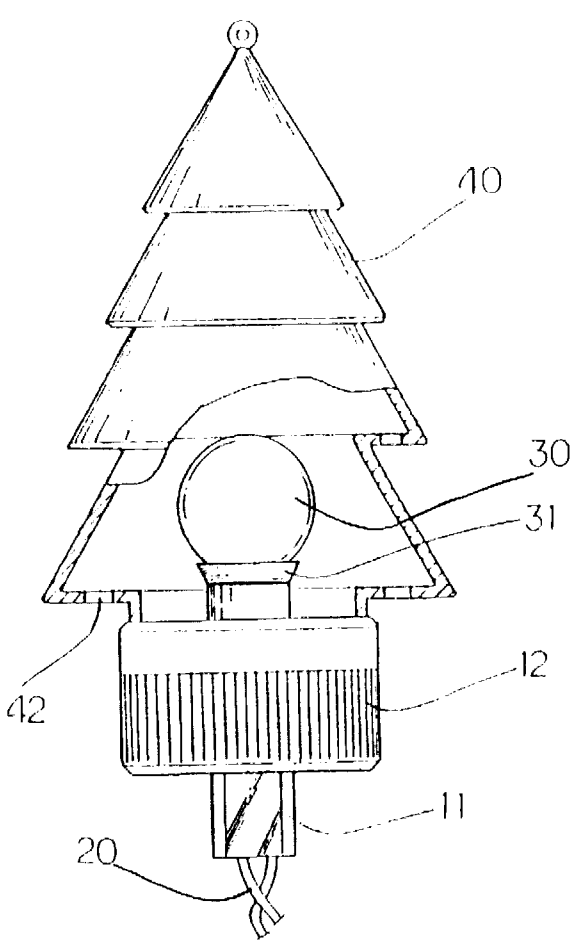
FIG. 9 shows another alternate form of the lampshade and another alternate form of the lamp bulb according to the present invention.
Figure 8:
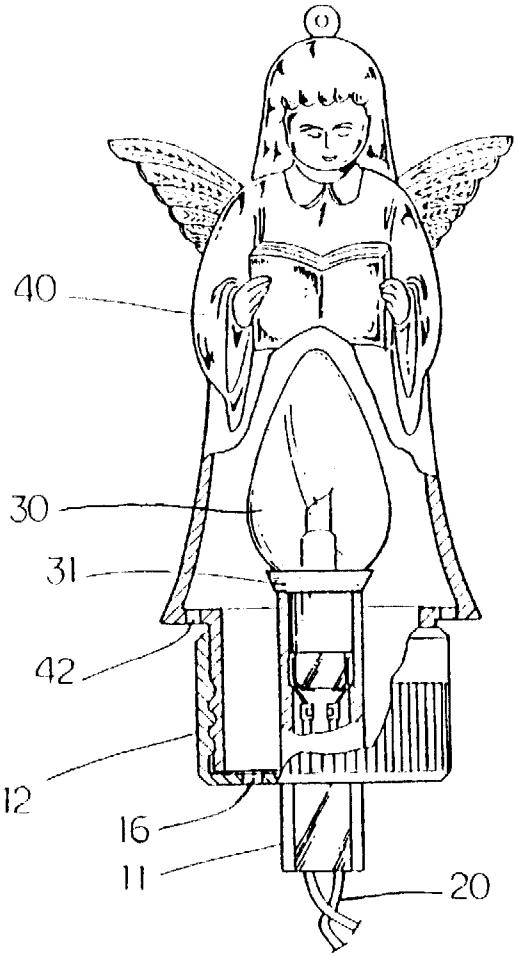
FIG. 8 shows an alternate form of the lampshade and an alternate form of the lamp bulb according to the present invention.

The aforesaid lampshade 40 and lamp bulb 30 may be variously shaped. FIGS. 8 and 9 show different shapes of the lampshade 40 and lamp bulb 30.

Figure 10:
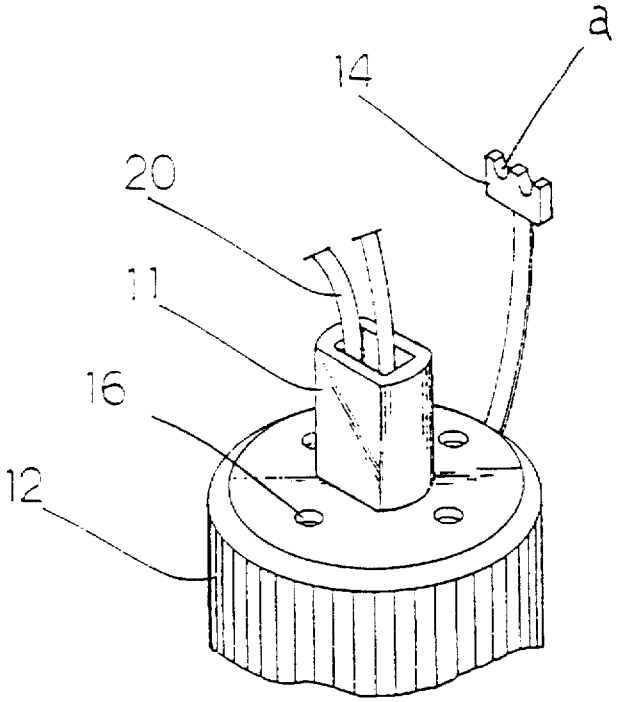
FIG. 10 is similar to FIG. 7 but showing the cap hinged to the cup-like holder base.

Referring to FIG. 10, as an alternate form of the present invention, the cap 14 can be hinged to the cup-like holder base 12.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A lamp for decorative light strings, comprising a lamp holder, a lamp base mounted in said lamp holder and holding a lamp bulb, a lampshade fastened to said lamp holder around said lamp base and said lamp bulb, and two electric wires respectively extended out of said lamp holder and having a respective contact terminal disposed in contact with the positive and negative terminals of said lamp bulb respectively, wherein said lamp holder comprises a cup-like holder base, an inner thread disposed around an inside wall of said cup-like holder base, a plurality of air vents at a bottom side of said cup-like holder base, a center barrel vertically disposed at the center of said cup-like holder base and defining a top receptacle, which receives said lamp base, and a hinged cap closed on one end of said center barrel remote from said top receptacle and having two semicircular notches for the passing of said electric wires; said lampshade has an outer thread around a bottom end thereof threaded into the inner thread of said cup-like holder base.

2. The lamp as claimed in claim 1, wherein said hinged cap is hinged to said center barrel outside said cup-like holder base.

3. The lamp as claimed in claim 1, wherein said hinged cap is hinged to said cup-like holder base.

* * * * *